US005507666A

United States Patent [19]

Yamanashi

[11] Patent Number: 5,507,666

[45] Date of Patent: Apr. 16, 1996

[54] LOCK SECURING MECHANISM FOR CONNECTORS

[75] Inventor: Makoto Yamanashi, Shizuoka, Japan

[73] Assignee: Yazaki Corporation, Tokyo, Japan

[21] Appl. No.: 363,826

[22] Filed: Dec. 27, 1994

[30] Foreign Application Priority Data

Dec. 28, 1993 [JP] Japan ..... 5-334706
Dec. 28, 1993 [JP] Japan ..... 5-334707

[51] Int. Cl.[6] ..... H01R 3/00

[52] U.S. Cl. ..... 439/489; 439/354

[58] Field of Search ..... 439/345, 350, 439/352–355, 357, 358, 488, 489

[56] References Cited

U.S. PATENT DOCUMENTS 4,950,179 8/1990 Takenouchi et al. ..... 439/352
5,203,718 4/1993 Chishima ..... 439/489
5,203,719 4/1993 Kozono ..... 439/489

FOREIGN PATENT DOCUMENTS 1-165582 11/1989 Japan .

*Primary Examiner*—Khiem Nguyen
*Attorney, Agent, or Firm*—Jacobson, Price, Holman & Stern

[57] ABSTRACT

A lock securing mechanism for securing mutual fitting of connectors for use in, e.g., connecting electric wires to each other is provided which can surely sense a half-fitted condition between connector housings and prevent troubles due to incomplete fitting. A lock arm is provided in a male housing, and a lock securing member having flexible latch fingers is attached to the male housing in a temporarily engaged condition where the flexible latch fingers are positioned to extend along the lock arm and also abut with the lock arm. A female housing has engagement releasing drive sticks which function to move the flexible latch fingers upward to release the temporary engagement between the male housing and the lock securing member so that the lock securing member can be moved into a completely engaged condition, when both the housings are fitted to each other. A raised sensing piece having an inclined surface is provided at a free end of the lock arm, and a sensing projection coming into abutment the raised sensing piece is provided on the lock securing member.

6 Claims, 8 Drawing Sheets

LOCK SECURING MECHANISM FOR CONNECTORS

BACKGROUND OF THE INVENTION

1. Field of the Invention

The present invention relates to a lock securing mechanism for securing mutual fitting of connectors for use in connecting electric wires to each other, for example, and to a lock securing member as a component of the lock securing mechanism.

2. Description of the Related Art

One example of conventional lock securing mechanisms for connectors is disclosed in Japanese Utility Model Laid-Open No. 1-165582. For securing mutual fitting between a male housing and a female housing, the disclosed lock securing mechanism for connectors includes a lock securing member which is always attached to one of the housings in a temporarily engaged condition. One housing has a lock arm which is displaceable in a rising direction for locking the male and female housings together. The lock securing member has a flexible latch finger positioned to extend parallel to the lock arm and also abut with an engagement boss provided on the lock arm in the temporarily engaged condition. The other housing is provided with a locking latch engaging the lock arm, and an engagement releasing drive stick for releasing the flexible latch finger from the abutted condition with the lock arm. When the male and female housings are fitted to each other, the engagement releasing drive stick pushes the flexible latch finger upward for shifting the lock securing member from the temporarily engaged position to the completely engaged position where the lock arm is prevented from displacing to hold both the housings in the locked condition.

If the male and female housings are in a half-fitted condition, the engagement releasing drive stick does not act upon the releasing the flexible latch finger to push it up. Therefore, a free end of the flexible latch finger is kept abutted with the engagement boss on the lock arm, making it impossible to further push the lock securing member into the male housing. Accordingly, an incomplete fitting condition of both the housings can be sensed by confirming that the lock securing member cannot be further pushed into the male housing.

To easily sense the half-fitted condition of the male and female housings, a sensing projection is provided on the flexible latch finger of the lock securing member and a sensing portion is formed at a free end of the lock arm. When the sensing portion and the sensing projection are abutted with each other in the half-fitted condition of both the housings, the lock securing member cannot be further pushed into the male housing, thus enabling the half-fitted condition to be easily sensed.

However, the increased number of connector cells requires a great pressing force to fit both the housings together, which leads to the following problem. The great pressing force causes an excessive force to act upon the abutting interface between the sensing portion and the sensing projection in the half-fitted condition. The lock arm and the flexible latch finger are thereby flexed upward to such an extent that the free end of the flexible latch finger is disengaged from the engagement boss on the lock arm and the sensing projection on the flexible latch finger passes beneath the sensing portion of the lock arm, allowing the lock securing member to further enter the male housing erroneously.

Furthermore, the lock securing member is attached to the male housing by inserting a mount rib provided on the lock securing member to a securing member insertion groove formed in the male housing.

However, if there is any play between the securing member insertion groove and the mount rib, the lock securing member is easily apt to incline, which leads to the following problem. Upon the pressing force being applied to the lock securing member, the lock securing member is inclined even in the half-fitted condition of both the housings to such a large extent that the free end of the flexible latch finger is disengaged from the engagement boss on the lock arm to allow further advancement of the lock securing member in spite of that the engagement releasing drive stick are not acting to push the flexible latch finger upward. This may result in a risk of causing troubles because the condition of fitting failure cannot be sensed.

Still another problem is that, if the mount rib is formed to come into close contact with the securing member insertion groove to eliminate a play between the securing member insertion groove and the mount rib, it would be so difficult to insert the lock securing member that some of the parts could not be practically used.

The present invention is intended to solve the problems described above.

SUMMARY OF THE INVENTION

An object of the present invention is to provide a lock securing mechanism for connectors which can surely sense a half-fitted condition between housings and prevent troubles due to incomplete fitting.

Another object of the present invention is to provide a lock securing member which contributes to an improvement in reliability of a lock securing mechanism for connectors and efficiency of the connector fitting step.

According to the present invention, there is provided a lock securing mechanism for connectors, comprising first and second housings having peripheral walls which are open in the longitudinal direction and can be fitted to each other, and containing terminal fixtures therein; a lock arm extending from one upper end of the peripheral wall of the first housing, which end is headed in the fitting direction, in a direction opposite to the fitting direction, and having a free end capable of displacing vertically; means provided in the second housing and engaging the lock arm; a lock securing member having a base portion provided with an unlock preventing portion which is engageable with the free end of the lock arm, and flexible latch means extending from the base portion to be positioned along the lock arm and to terminate at a free end, the lock securing member being attached to the first housing from the side opposite to the fitting direction to be movable in a direction in which the flexible latch means is extended; temporarily engaging means provided in the first housing to be temporarily engaged with the free end of the flexible latch means when the lock securing member is attached to the first housing; engagement releasing means provided in the second housing for displacing the flexible latch means in the rising direction of the lock arm to release the flexible latch means from the temporary engagement with the temporarily engaging means, and then moving the lock securing member to completely engage the flexible latch means with the first housing and to engage the unlock preventing portion with the lock arm, when the first and second housings are fitted to each other and the lock arm is engaged with the lock arm engaging means; and incomplete fitting preventing means provided on at least one of the lock arm and the lock securing member.

In a preferable embodiment of the present invention, the incomplete fitting preventing means includes a raised sensing piece provided at the free end of the lock arm and having an inclined surface formed at an acute angle with respect to the direction in which the lock arm is extended, and a sensing projection provided on the flexible latch means and coming into abutment with the inclined surface.

In another preferable embodiment of the present invention, the incomplete fitting preventing means includes a sensing projection vertically provided on the flexible latch means at an intermediate position and having a distal end portion inclined toward the free end of the flexible latch means, and a raised sensing piece provided at the free end of the lock arm and coming into abutment with the sensing projection.

With the above arrangement, the inclined surface is formed on the raised sensing piece of the lock arm or on the sensing projection of the lock securing member. Therefore, even if the lock securing member is subject to an excessive pressing force in the condition where both the connector housings are half-engaged with each other, the inclined surface functions to develop a force tending to urge the lock arm downward to prevent it from flexing upward. Accordingly, the lock securing member is surely prevented from further entering the first housing erroneously, making it possible to prevent troubles due to erroneous insertion of the lock securing member and to improve reliability remarkably.

In still another preferable embodiment of the present invention, the first housing has a groove to which the lock securing member is inserted, a mount rib to be inserted to the groove is provided on the lock securing member, and the incomplete fitting preventing means includes a gap adjusting boss provided on the mount rib.

With this embodiment, when the mount rib is inserted to the securing member insertion groove in the housing, the mount rib is closely contacted the securing member insertion groove at the position of the gap adjusting boss. Accordingly, the lock securing member is stably held in the housing and will not incline even upon an external force being applied, thereby keeping the flexible latch means remain in the same position. It is thus possible to surely prevent further advancement of the lock securing member in the half-fitted condition of both the housings, and to surely prevent troubles due to incomplete fitting of both the housings. Additionally, since the mount rib is closely contacted with the securing member insertion groove, the lock securing member is held in a highly stable condition regardless whether the mount rib are long or short, and hence it is adaptable for various kinds of connectors.

Other objects and advantages of the present invention will be apparent from the following description of embodiments with reference to the accompanying drawings.

DESCRIPTION OF PREFERRED EMBODIMENTS

Figure 1:
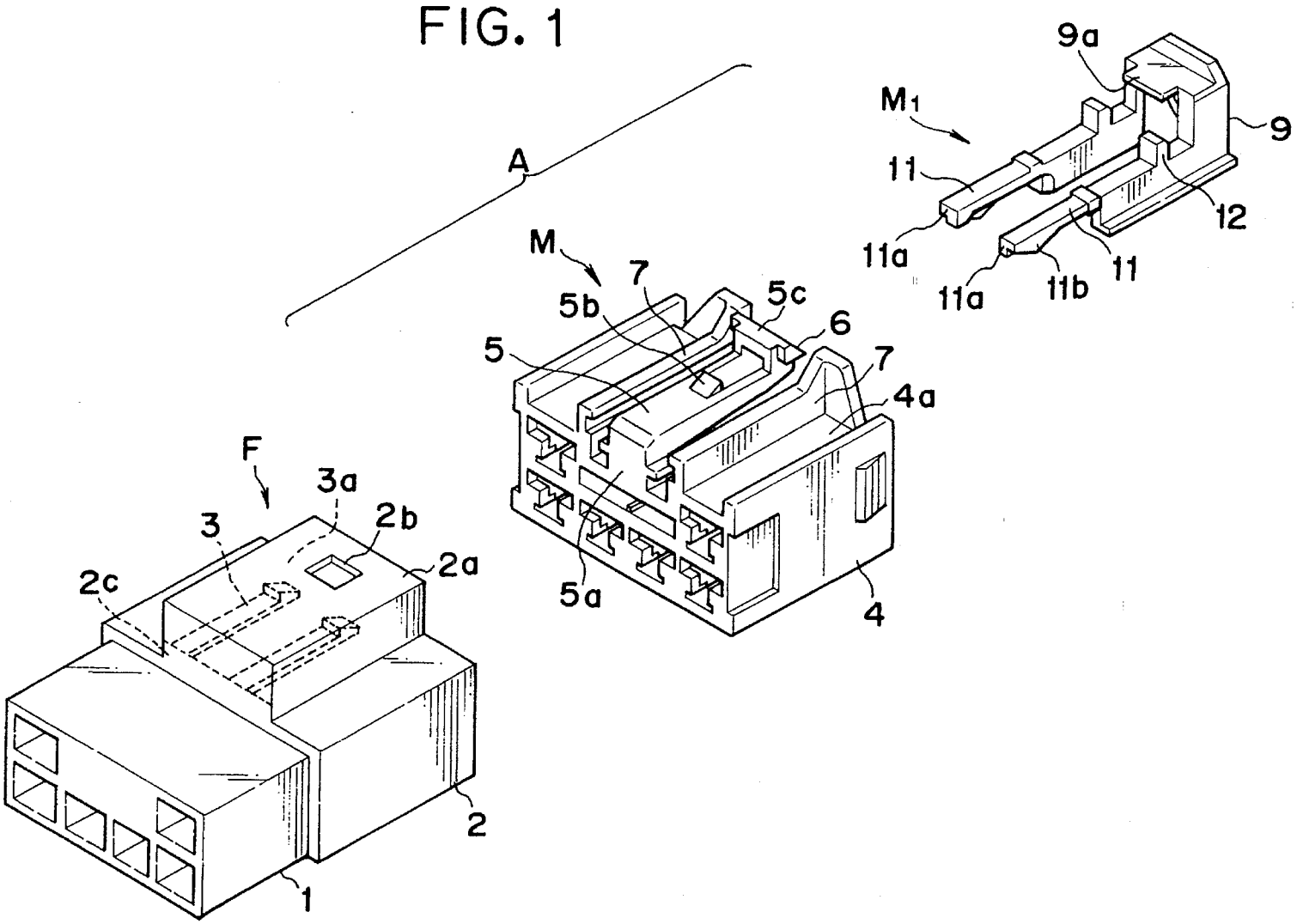
FIG. 1 is a perspective view showing an embodiment of a lock securing mechanism according to the present invention.

Referring to FIG. 1, a lock securing mechanism A according to the present invention comprises a female housing F and a male housing M which constitute a pair of connector housings, and a lock securing member $M_1$.

The female housing F comprises a body portion i for containing a terminal fixture (not shown), and a casing portion 2 formed on the front side of the body portion 1 in continuous relation for receiving the male housing M. The casing portion 2 has a raised upper wall 2*a* in its central area, and a lock hole 2*b* as a locking latch is formed at the center of the upper wall 2*a*. A partition 2*c* is disposed at the joint between the casing portion 2 and the body portion 1 to divide the housing interior into two parts. Two engagement releasing drive sticks 3 are extended from the partition 2*c* forward in the casing portion 2 in a cantilevered fashion. Each of the engagement releasing drive sticks 3 has a drive boss 3*a* which is formed at its free end and acts upon the lock securing member $M_1$ attached to the male housing M.

Figure 2:
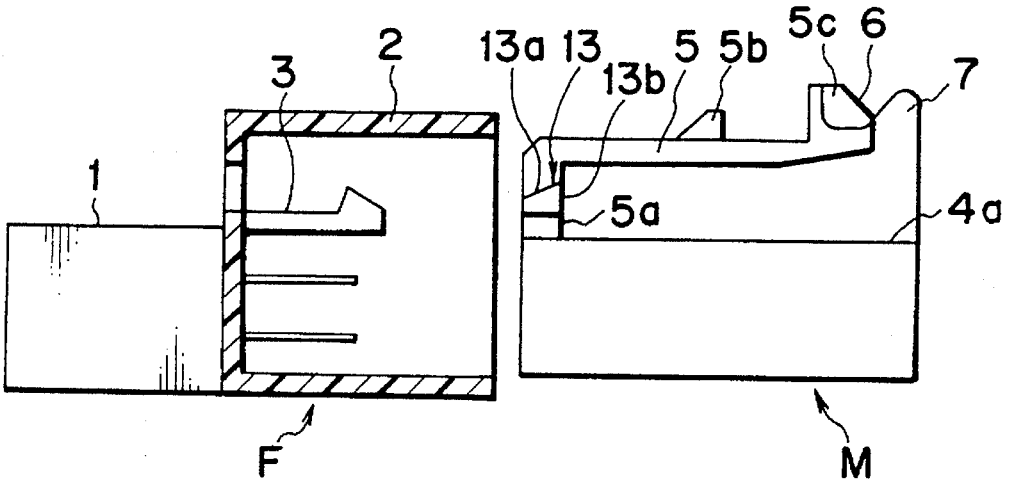
FIG. 2 is a side view showing principal parts of a male housing and a female housing shown in FIG. 1.

The male housing M comprises a body portion 4 for containing a terminal fixture (not shown), and has an upper wall 4*a* with a recess defined at the center thereof. A raised base 5*a* is formed in the recess of the upper wall 4*a*, and a lock arm 5 is extended rearward from the raised base 5*a*. Also as shown in FIG. 2, the lock arm 5 is provided with a lock boss 5*b* in its intermediate region, and with a raised sensing piece 5*c* at its rear end which is extended upward and laterally beyond the width of the lock arm 5. The raised sensing piece 5c has an inclined surface 6 formed thereon at an acute angle with respect to the direction in which the lock arm 5 is extended (rearward). A pair of protective walls 7 are vertically provided on both sides of the lock arm 5 to extend parallel with a spacing left relative to the lock arm 5.

Figure 3:
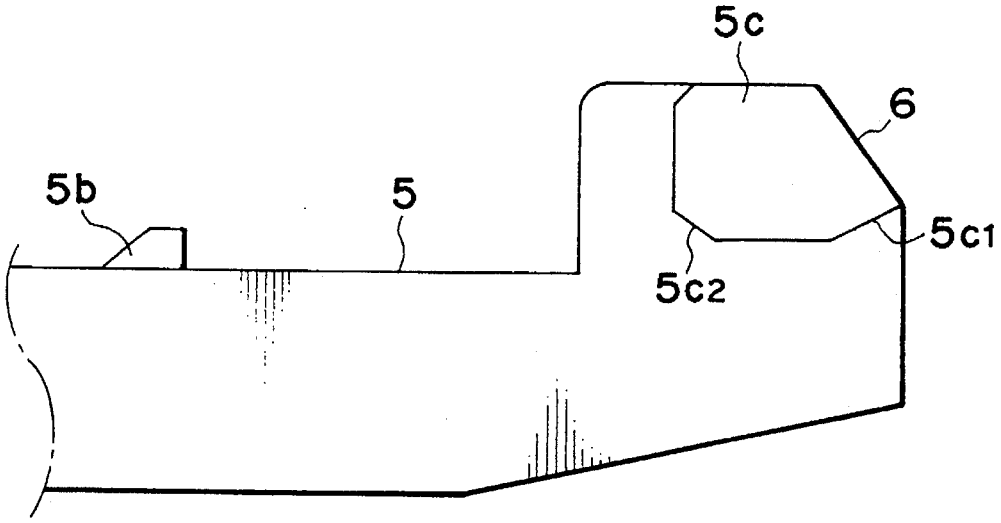
FIG. 3 is a side view showing a free end of a lock arm shown in FIG. 2 in enlarged scale.

As detailed in FIG. 3, laterally opposite undersides of the raised sensing piece 5c include each a tapered insertion-aid surface $5C_1$ which assists in fitting the lock securing member $M_1$ and a tapered release-aid surface $5C_2$ which assists in disengaging the lock securing member $M_1$.

When the female housing F and the male housing M are fitted to each other, the lock boss 5b on the lock arm 5 is engaged in the lock hole 2b to securely lock the mutual fitting between the female and male housings.

The lock securing member $M_1$ comprises a gate-shaped base portion 9 and bifurcated flexible latch fingers 11, 11 which are extended from a lower end of the base portion 9 at opposite outer locations in cantilevered fashion so as to position on both sides of the lock arm 5 of the male housing M. The lock securing member $M_1$ is fitted between the pair of protective walls 7 of the male housing M. From a top end of the base portion 9, there is forwardly projected an unlock preventing jut 9a for holding down the raised sensing piece 5c of the lock arm 5 from above in the condition where both the housings are fitted together. The flexible latch finger 11 has a tapered driven surface 11b formed in its underside leading to a free end 11a thereof, and an engagement recess 11c formed midway in the tapered driven surface 11b on the side near its inner edge. In an intermediate region between the base portion 9 and the flexible latch finger 11, there is vertically provided a sensing projection 12 coming into abutment with the raised sensing piece 5c of the lock arm 5. Further, the lock arm 5 is provided on both outer lateral surfaces of the raised base portion 5a with engagement bosses 13 each having a front tapered surface 13a and a rear abutment surface 13b.

Figure 5:
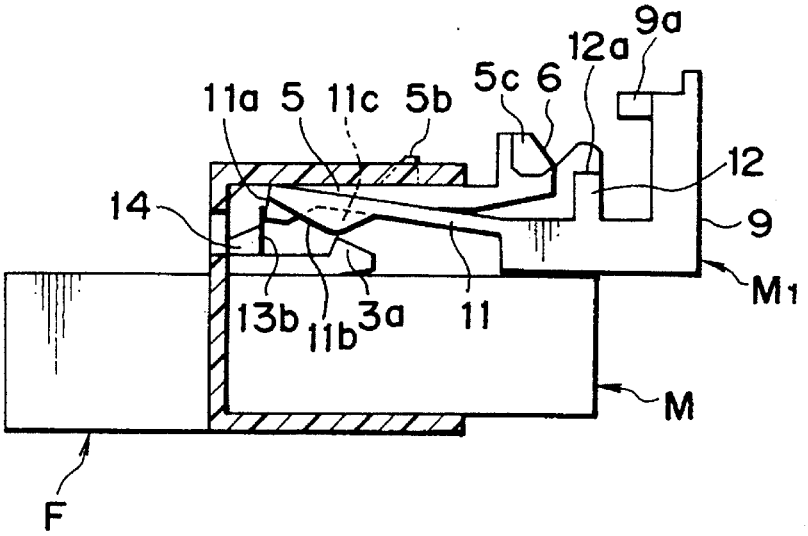
FIG. 5 is an explanatory view showing a step of inserting the male housing to the female housing from the condition of FIG. 4.
Figure 6:
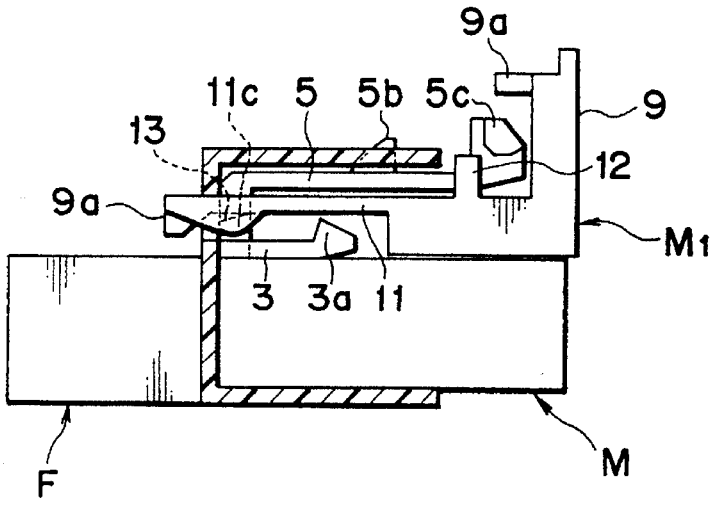
FIG. 6 is an explanatory view showing a condition where the male housing is fitted into the female housing from the condition of FIG. 5.

The operation of the lock securing member $M_1$ when the female housing F and the male housing M are fitted to each other will now be described with reference to FIGS. 4 to 6.

Figure 4:
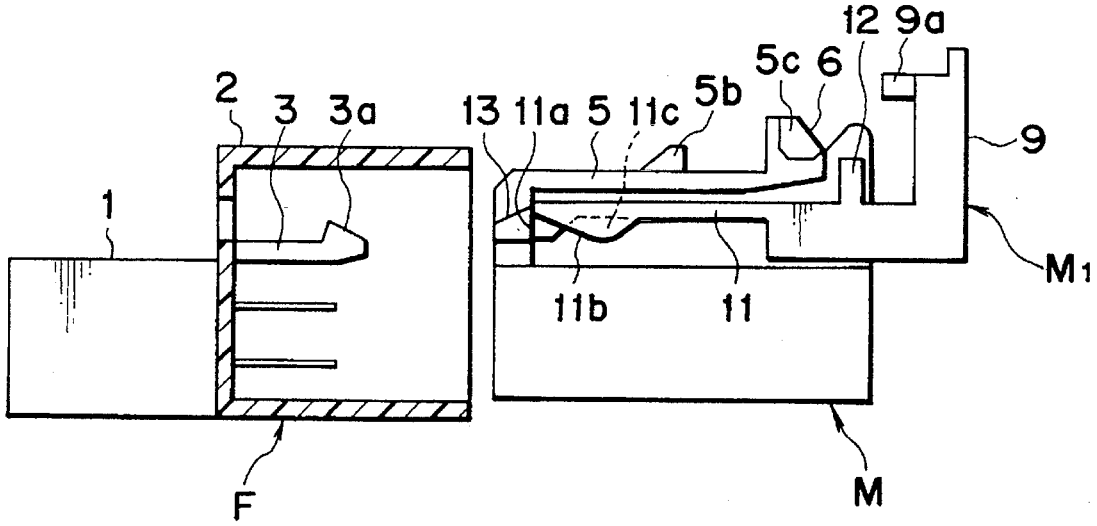
FIG. 4 is an explanatory view showing a temporarily engaged condition between the male housing and a lock securing member.

First, the lock securing member $M_1$ is pushed into between the protective walls 7 and 7 of the male housing M from behind such that the free ends 11a of the flexible latch fingers 11 abut with the abutment surfaces 13b of the engagement bosses 13 provided on both outer lateral surfaces of the raised base portion 5a of the lock arm 5, as shown in FIG. 4, thereby holding the lock securing member $M_1$ and the male housing M in a temporarily engaged condition. Then, by fitting the male housing M under the above condition into the female housing F, as shown in FIG. 5, the lock boss 5b on the lock arm 5 is engaged in the lock hole 2b and, simultaneously, the engagement releasing drive sticks 3 provided in the female housing F pass beneath the engagement bosses 13 to reach the undersides of the flexible latch fingers 11. Consequently, the drive bosses 3a press the tapered driven surfaces 11b to raise the free ends 11a of the flexible latch fingers 11 so that the free ends 11a of the flexible latch fingers 11 are disengaged from the abutment surfaces 13b of the engagement bosses 13.

At this time, as the free ends 11a of the flexible latch fingers 11 are raised, the lock securing member $M_1$ is entirely inclined in a rearward and downward direction. With further advancement of the lock securing member $M_1$, therefore, top ends 12a of the sensing projections 12 on the flexible latch fingers 11 come into contact with the tapered insertion-aid surfaces 5c1 (see FIG. 3) of the raised sensing piece 5c. Then, the sensing projections 12 are guided by the tapered insertion-aid surfaces 5c1 to enter the side of the tapered release-aid surfaces 5c2 of the raised sensing piece 5c, as shown in FIG. 6, resulting in a completely engaged condition where the engagement recesses 11c of the flexible latch fingers 11 are engaged with the engagement bosses 13. As a consequence, mutual coupling between the female housing F and the male housing M is secured.

When the lock securing member $M_1$ is subject to an excessive pressing force in the condition where the female housing F and the male housing M are half-engaged with each other, the inclined surface 6 of the raised sensing piece 5c functions to develop a force tending to urge the lock arm 5 downward upon the sensing projections 12 on the flexible latch fingers 11 abutting with the raised sensing piece 5c. Therefore, the lock arm will not flex upward, ensuring that the lock securing member $M_1$ is surely prevented from further entering the male housing erroneously.

In order to develop the force tending to urge the lock arm 5 downward when the lock securing member $M_1$ is subject to an excessive pressing force, the inclined surface 6 is formed on the raised sensing piece 5c of the lock arm in the above embodiment. As an alternative, the sensing projections 12 on the flexible latch fingers 11 may be formed to incline toward the respective free ends of the flexible latch fingers 11.

Figure 7:
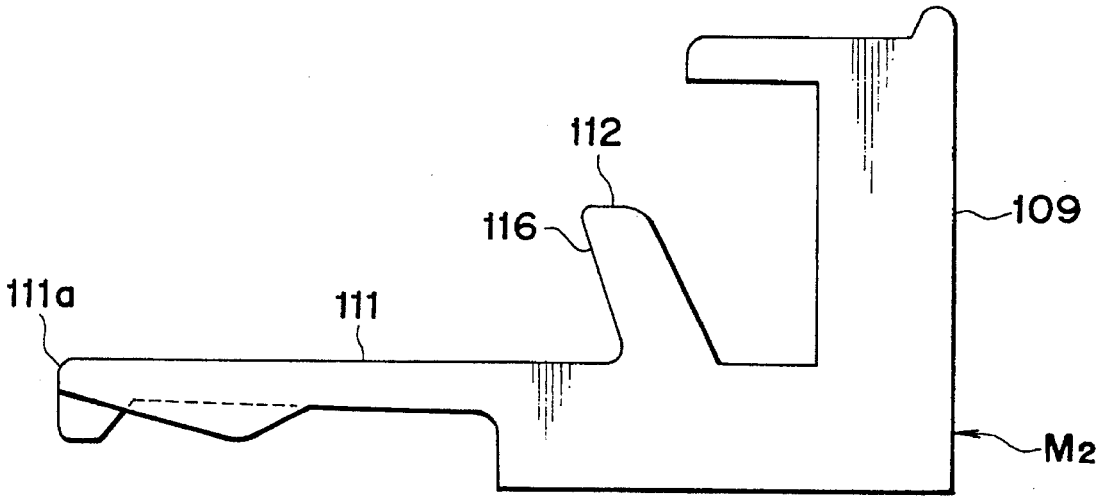
FIG. 7 is a side view showing another embodiment of the lock securing member according to the present invention.

A lock securing member $M_2$ according to another embodiment of the present invention will be described below with reference to FIG. 7. In an intermediate region between a base portion 109 and a flexible latch finger 111, there is vertically provided a sensing projection 112 which has an inclined surface 116 formed at an acute angle with respect to the direction in which a free end 111a of the flexible latch finger 111 is extended.

Thus, instead of the inclined surface 6 formed on the raised sensing piece 5c of the lock arm 5 in the above embodiment, the inclined surface 116 is formed on the sensing projection 112. With this construction, when the lock securing member $M_2$ is subject to an excessive pressing force in the condition where the female housing F and the male housing M are half-engaged with each other, the raised sensing piece 5c of the lock arm 5 abuts with the inclined surface 116 of the sensing projection 112 and, at this time, the inclined surface 6 functions to develop a force tending to urge the lock arm 5 downward. As with the above embodiment, therefore, the lock arm 5 will not flex upward, ensuring that the lock securing member $M_2$ is surely prevented from further entering the male housing erroneously.

Figure 8:
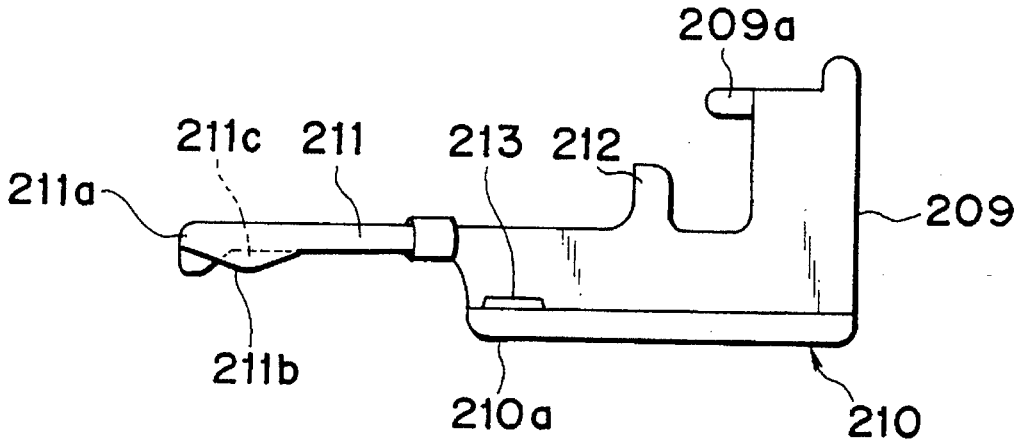
FIG. 8 is a side view showing still another embodiment of the lock securing member according to the present invention.
Figure 9:
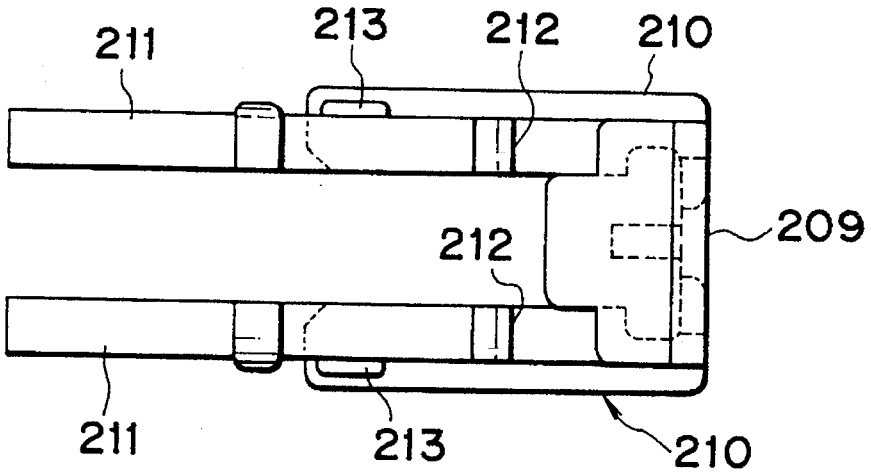
FIG. 9 is a plan view of the lock securing member shown in FIG. 8.
Figure 10:
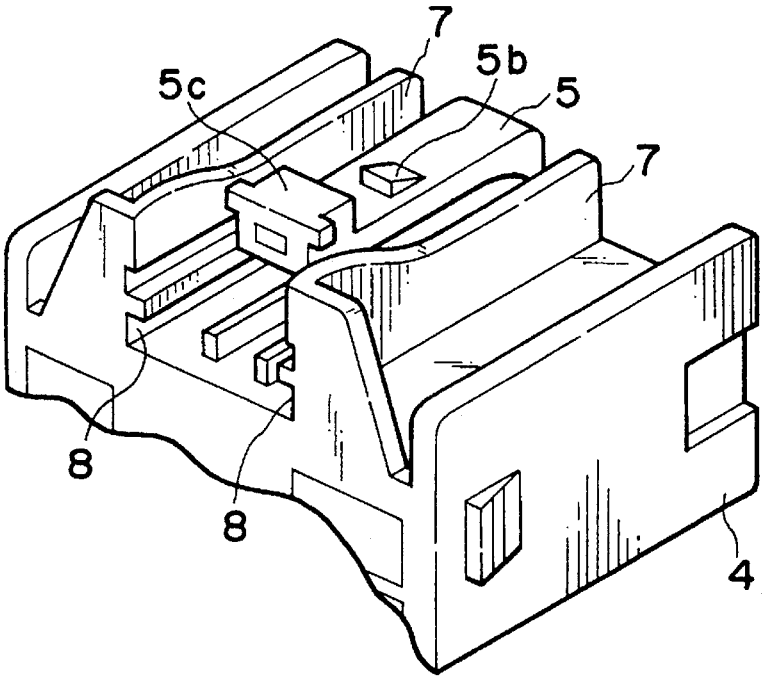
FIG. 10 is a perspective view showing principal part of a male housing adapted for the lock securing member shown in FIG. 8.

A lock securing mechanism according to still another embodiment of the present invention will be described below with reference to FIGS. 8 to 11. A lock securing member $M_3$ comprises, as shown in FIGS. 8 and 9, a gate-shaped base portion 209, a pair of mount ribs 210 provided at a lower end of the base portion 209 on outer lateral surfaces thereof, respectively, and bifurcated flexible latch fingers 211, 211 which are extended from the lower end of the base portion 209 at the opposite outer locations along inwardly of the mount ribs 210 in cantilevered fashion so as to position on both sides of the lock arm 5 of the male housing M shown in FIG. 10. From a top end of the base portion 209, there is forwardly projected an unlock preventing jut 209a for holding down the raised sensing piece 5c of the lock arm 5 from above in the condition where the housings are fitted together. The flexible latch finger 211 has a tapered driven surface 211b formed in its underside leading to a free end 211a thereof, and an engagement recess 211c formed midway in the tapered driven surface 211b on the side near its inner edge. In an intermediate region between the base portion 209 and the flexible latch finger 211, there is vertically provided a sensing projection 212. A gap adjusting boss 213 substantially in the form of a grain of rice is provided on an upper surface of the mount rib 210 at its end 210*a* near the flexible latch finger 211.

Figure 11:
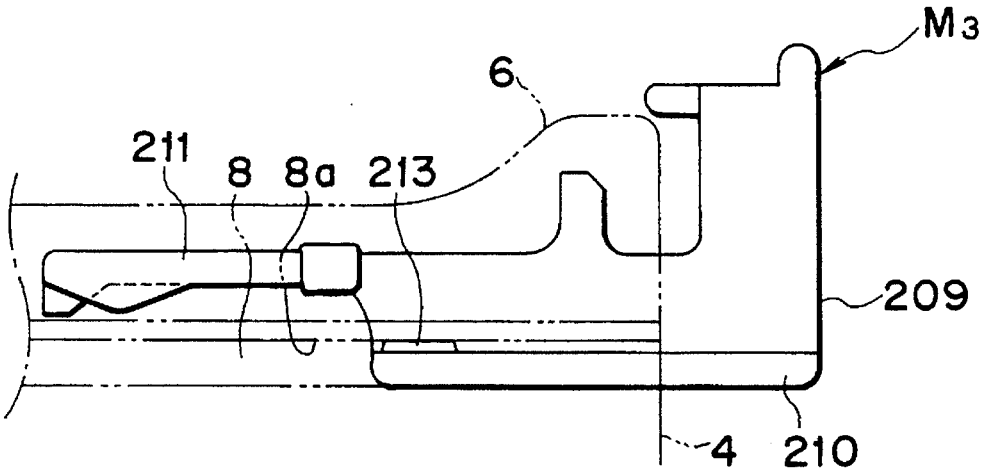
FIG. 11 is an explanatory view showing a condition of the lock securing member shown in FIG. 8 being attached to the male housing shown in FIG. 10.

As shown in FIG. 11, the lock securing member $M_3$ is attached to the make housing M by inserting mount ribs 210 to respective securing member insertion grooves 8 formed in the protective walls 7 of the male housing M.

The gap adjusting boss 213 is formed to have a height selected such that it comes to close contact with an upper wall 8*a* of the securing member insertion groove 8, but have a small contact area with the upper wall 8*a* to such an extent that contact resistance becomes small and the boss 213 can be easily inserted to the groove 8. Accordingly, there produces no play between the gap adjusting boss 213 and the securing member insertion groove 8, and even if an external force acts upon the base portion 209 of the lock securing member $M_3$, the lock securing member $M_3$ is supported at the positions of the gap adjusting bosses 213 to prevent it from inclining. As a result, the positions of the flexible latch fingers 211 will not be adversely affected.

The operation of the lock securing member $M_3$ when the female housing F and the male housing M are fitted to each other will now be described with reference to FIGS. 12 to 14.

Figure 12:
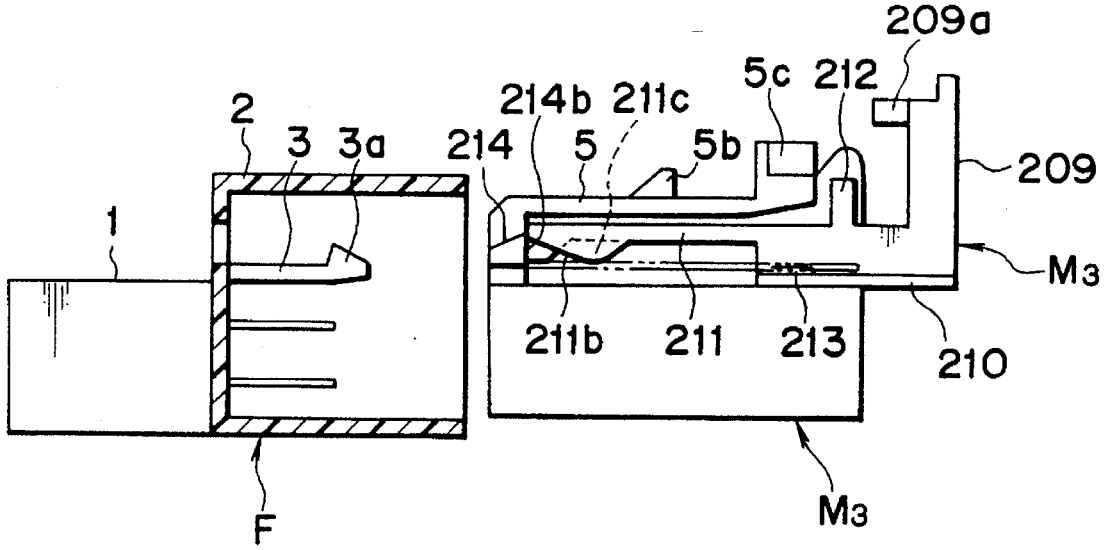
FIG. 12 is an explanatory view showing a condition where the lock securing member and the male housing shown in FIG. 11 are temporarily engaged with each other.
Figure 13:
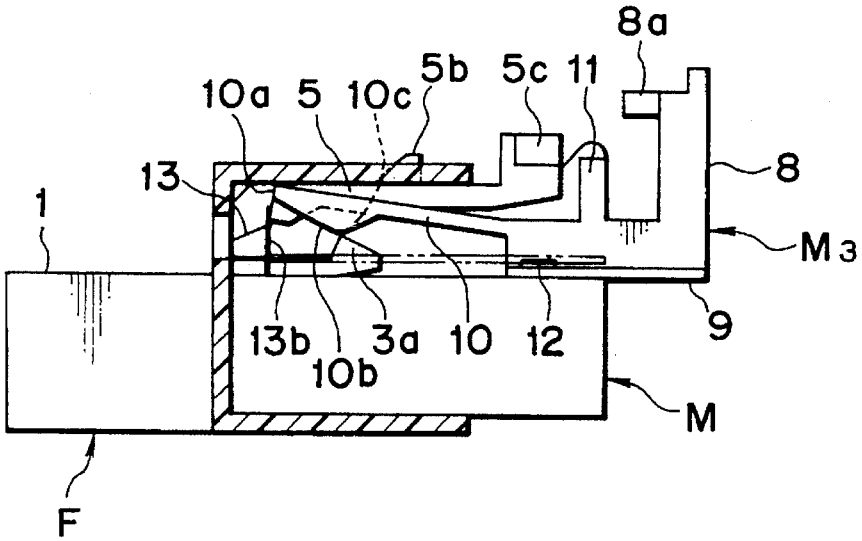
FIG. 13 is an explanatory view showing a step of inserting the male housing to the female housing from the condition of FIG. 12.

First, the lock securing member $M_3$ is pushed into between the protective walls 7 and 7 of the male housing M from behind such that the free ends 211*a* of the flexible latch fingers 211 abut with the abutment surfaces 13*b* of the engagement bosses 13 provided on both outer lateral surfaces of the raised base portion 5*a* of the lock arm 5, as shown in FIG. 12, thereby holding the lock securing member $M_3$ and the male housing M in a temporarily engaged condition. Then, by fitting the male housing M under the above condition into the female housing F, as shown in FIG. 13, the lock boss 5*b* on the lock arm 5 is engaged in the lock hole 2*b* and, simultaneously, the engagement releasing drive sticks 3 provided in the female housing F pass beneath the engagement bosses 13 to reach the undersides of the flexible latch fingers 211. Consequently, the drive bosses 3*a* press the tapered driven surfaces 211*b* to raise the free ends 211*a* of the flexible latch fingers 211 so that the free ends 211*a* of the flexible latch fingers 211 are disengaged from the abutment surfaces 13*b* of the engagement bosses 13.

Figure 14:
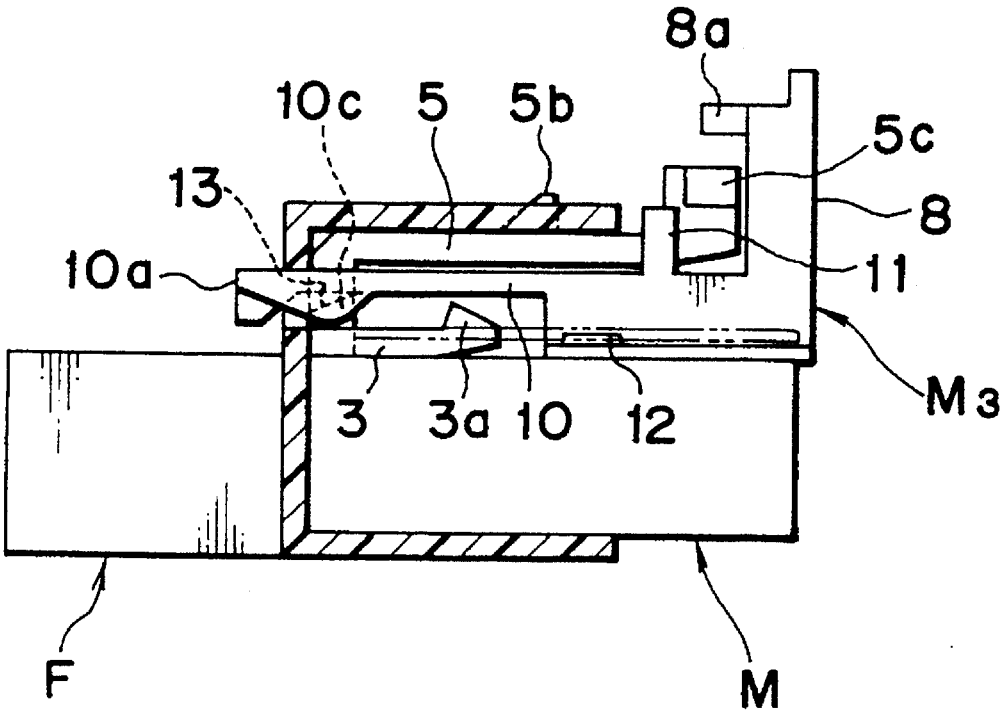
FIG. 14 is an explanatory view showing a condition where the male housing is fitted into the female housing from the condition of FIG. 13.

With further advancement of the lock securing member $M_3$ from the above condition, the sensing projections 212 on the flexible latch fingers 211 pass beneath the raised sensing piece 5*c* of the lock arm 5, as shown in FIG. 14, resulting in a completely engaged condition where the engagement recesses 211*c* of the flexible latch fingers 211 are engaged with the engagement bosses 13. As a consequence, mutual coupling between the female housing F and the male housing M is secured.

Since the mount ribs 210 of the lock securing member $M_3$ in this embodiment include the gap adjusting bosses 213, there produce no plays between the gap adjusting bosses 213 and the securing member insertion grooves 8. Therefore, the lock securing member $M_3$ is held in a highly stable condition and a fitting failure otherwise occurred in the step of fitting the female housing F and the male housing M to each other is prevented. The shape of the gap adjusting boss 213 is not limited to the one described above, but may be hemispherical or hemi-ellipsoidal, for example.

According to the lock securing member of this embodiment, since the gap adjusting bosses are provided at the ends of the mount ribs near the flexible latch fingers, no plays will be produced between the securing member insertion grooves in the housing and the mount ribs, making it possible to surely prevent troubles due to incomplete fitting of both the housings and hence to remarkably increase reliability. Also, since the lock securing member is easily fitted to the housings, efficiency of the housing fitting step is greatly improved. Additionally, since the lock securing member is held in a highly stable condition with respect to the housing regardless whether the mount ribs are long or short, it is adaptable for various kinds of connectors.

What is claimed is:

1. A lock securing mechanism for connectors, comprising:

first and second housings having peripheral walls which are open in the longitudinal direction and can be fitted to each other, and containing terminal fixtures therein, a lock arm extending from one upper end of the peripheral wall of said first housing in a direction opposite to the fitting direction, and having a free end capable of displacing vertically, means provided in said second housing and engaging said lock arm, a lock securing member having a base portion provided with an unlock preventing portion which is engageable with the free end of said lock arm, and flexible latch means extending from said base portion to be positioned along said lock arm and to terminate at a free end, said lock securing member being attached to said first housing from the side opposite to the fitting direction to be movable in a direction in which said flexible latch means is extended, temporarily engaging means provided in said first housing to be temporarily engaged with the free end of said flexible latch means when said lock securing member is attached to said first housing, engagement releasing means provided in said second housing for displacing said flexible latch means in the rising direction of said lock arm to release said flexible latch means from the temporary engagement with said temporarily engaging means, and then moving said lock securing member to completely engage said flexible latch means with said first housing and to engage said unlock preventing portion with said lock arm, when said first and second housings are fitted to each other and said lock arm is engaged with said lock arm engaging means, and incomplete fitting preventing means provided on at least one of said lock arm and said lock securing member, said incomplete fitting preventing means includes a raised sensing piece provided at the free end of said lock arm and having an inclined surface formed at an acute angle with respect to the direction in which said lock arm is extended, and a sensing projection provided on said flexible latch means and coming into abutment with said inclined surface.

2. A lock securing mechanism for connectors, comprising:

first and second housings having peripheral walls which are open in the longitudinal direction and can be fitted to each other, and containing terminal fixtures therein, and a lock securing member movably attached to said first housing and securing mutual fitting between said first and second housings, said first housing including a lock arm extending from one upper end of the peripheral wall thereof in a direction opposite to the fitting direction, a free end capable of displacing vertically, and a lock boss provided in an intermediate region thereof, said second housing including a peripheral wall portion defining a cavity into which said first housing is fitted, a peripheral wall portion defining a terminal fixture containing portion, a partition disposed between said both peripheral wall portions, and a lock hole formed in an upper wall of said peripheral wall portion defining said cavity to be engaged with said lock boss on said lock arm when said both housings are fitted together, said lock securing member having a base portion provided with an unlock preventing jut which is engageable with the free end of said lock arm when said first and second housings are fitted together, and two flexible latch fingers extending from said base portion to be positioned along both sides of said lock arm and to terminate at free ends, said first housing further including engagement bosses which are temporarily engaged with the free ends of said flexible latch fingers when said lock securing member is attached to said first housing, said second housing further including engagement releasing drive sticks provided to extend from said partition into said cavity for displacing said flexible latch fingers in the rising direction of said lock arm to release said flexible latch fingers form the temporary engagement with said engagement bosses, and then moving said lock securing member to completely engage said flexible latch fingers with said first housing and to engage said unlock preventing jut with said lock arm, when said first and second housings are fitted to each other and said lock boss on said lock arm is engaged in said lock hole, one of said lock arm and said lock securing member being provided with a first sensing member having an inclined surface, and the other being provided with a second sensing member coming into abutment with said first sensing member, said first sensing member is a raised member which is provided at the free end of said lock arm, has an inclined surface formed at an acute angle with respect to the direction in which said lock arm is extended, and is extended beyond the width of said lock arm, and said second sensing member is a projection provided on each of said flexible latch fingers in its intermediate region and coming into abutment with the inclined surface of said raised member.

3. A lock securing member for use in a lock securing mechanism for connectors, said mechanism comprising first and second housings having peripheral walls which are open in the longitudinal direction and can be fitted to each other, and containing terminal fixtures therein, and a lock securing member movably attached to said first housing and securing mutual fitting between said first and second housings, said first housing including a lock arm extending from one upper end of the peripheral wall thereof, in a direction opposite to the fitting direction, and a free end capable of displacing vertically, protective walls vertically provided on both sides of said lock arm and each having a groove to which said lock securing member is inserted, and engagement bosses temporarily engaging free ends of flexible latch fingers when said lock securing member is attached to said first housing, said second housing including a peripheral wall portion defining a cavity into which said first housing is fitted, a peripheral wall portion defining a terminal fixture containing portion, a partition disposed between said both peripheral wall portions, a lock hole formed in an upper wall of said peripheral wall portion defining said cavity to be engaged with said lock boss on said lock arm when said both housings are fitted together, and engagement releasing drive sticks provided to extend from said partition into said cavity for displacing said flexible latch fingers in the rising direction of said lock arm to release said flexible latch fingers from the temporary engagement with said engagement bosses, and then moving said lock securing member to completely engage said flexible latch fingers with said first housing and to engage said lock securing member with said lock arm, when said first and second housings are fitted to each other and said lock boss on said lock arm is engaged in said lock hole, wherein:

said lock securing member includes a base portion provided with an unlock preventing portion which is engageable with the free end of said lock arm when said first and second housings are fitted together, two flexible latch fingers extending from said base portion to be positioned along both sides of said lock arm and to terminate at free ends, and mount ribs which are provided at a lower end of said base portion to be inserted to the insertion grooves formed in the protective wall of said first housing, and which have gap adjusting bosses.

4. A lock securing mechanism for connectors, comprising:

first and second housings having peripheral walls which are open in the longitudinal direction and can be fitted to each other, and containing terminal fixtures therein, a lock arm extending from one upper end of the peripheral wall of said first housing in a direction opposite to the fitting direction, and having a free end capable of displacing vertically, means provided in said second housing and engaging said lock arm, a lock securing member having a base portion provided with an unlock preventing portion which is engageable with the free end of said lock arm, and flexible latch means extending from said base portion to be positioned along said lock arm and to terminate at a free end, said lock securing member being attached to said first housing from the side opposite to the fitting direction to be movable in a direction in which said flexible latch means is extended, temporarily engaging means provided in said first housing to be temporarily engaged with the free end of said flexible latch means when said lock securing member is attached to said first housing, engagement releasing means provided in said second housing for displacing said flexible latch means in the rising direction of said lock arm to release said flexible latch means from the temporary engagement with said temporarily engaging means, and then moving said lock securing member to completely engage said flexible latch means with said first housing and to engage said unlock preventing portion with said lock arm, when said first and second housings are fitted to each other and said lock arm is engaged with said lock arm engaging means, and incomplete fitting preventing means provided on at least one of said lock arm and said lock securing member, said incomplete fitting preventing means includes a sensing projection vertically provided on said flexible latch means at an intermediate position having a distal end portion inclined toward the free end of said flexible latch means, and a raised sensing piece provided at the free end of said lock arm and coming into abutment with said sensing projection.

5. A lock securing mechanism for connectors, comprising:

first and second housings having peripheral walls which are open in the longitudinal direction and can be fitted to each other, and containing terminal fixtures therein, a lock arm extending from one upper end of the peripheral wall of said first housing in a direction opposite to the fitting direction, and having a free end capable of displacing vertically, means provided in said second housing and engaging said lock arm, a lock securing member having a base portion provided with an unlock preventing portion which is engageable with the free end of said lock arm, and flexible latch means extending from said base portion to be positioned along said lock arm and to terminate at a free end, said lock securing member being attached to said first housing from the side opposite to the fitting direction to be movable in a direction in which said flexible latch means is extended, temporarily engaging means provided in said first housing to be temporarily engaged with the free end of said flexible latch means when said lock securing member is attached to said first housing, engagement releasing means provided in said second housing for displacing said flexible latch means in the rising direction of said lock arm to release said flexible latch means from the temporary engagement with said temporarily engaging means, and then moving said lock securing member to completely engage said flexible latch means with said first housing and to engage said unlock preventing portion with said lock arm, when said first and second housings are fitted to each other and said lock arm is engaged with said lock arm engaging means, and incomplete fitting preventing means provided on at least one of said lock arm and said lock securing member, said first housing has a groove to which said lock securing member is inserted, a mount rib to be inserted to said groove is provided on said lock securing member, and said incomplete fitting preventing means includes a gap adjusting boss provided on said mount rib.

6. A lock securing mechanism for connectors, comprising:

first and second housings having peripheral walls which are open in the longitudinal direction and can be fitted to each other, and containing terminal fixtures therein, a lock arm extending from one upper end of the peripheral wall of said first housing in a direction opposite to the fitting direction, and having a free end capable of displacing vertically, means provided in said second housing and engaging said lock arm, a lock securing member having a base portion provided with an unlock preventing portion which is engageable with the free end of said lock arm, and flexible latch means extending from said base portion to be positioned along said lock arm and to terminate at a free end, said lock securing member being attached to said first housing from the side opposite to the fitting direction to be movable in a direction in which said flexible latch means is extended, temporarily engaging means provided in said first housing to be temporarily engaged with the free end of said flexible latch means when said lock securing member is attached to said first housing, engagement releasing means provided in said second housing for displacing said flexible latch means in the rising direction of said lock arm to release said flexible latch means from the temporary engagement with said temporarily engaging means, and then moving said lock securing member to completely engage said flexible latch means with said first housing and to engage said unlock preventing portion with said lock arm, when said first and second housings are fitted to each other and said lock arm is engaged with said lock arm engaging means, and incomplete fitting preventing means provided on at least one of said lock arm and said lock securing member, said first sensing member is a projection provided on each of said flexible latch fingers at its intermediate region and having a distal end portion inclined toward the free end of said flexible latch finger, and said second sensing member is a raised member which is provided at the free end of said lock arm, is extended beyond the width of said lock arm, and comes into abutment with the inclined surface of aid raised member.

* * * * *